US005150810A

United States Patent [19]

Loebbert

[11] Patent Number: 5,150,810

[45] Date of Patent: Sep. 29, 1992

[54] WASTE DISPOSAL BAG WITH A BAG COLLAR AND LID

[76] Inventor: Johannes Loebbert, Lindenstrasse 22, 4405 Nottuln 2, Fed. Rep. of Germany

[21] Appl. No.: 745,034

[22] Filed: Sep. 3, 1991

Related U.S. Application Data

[60] Division of Ser. No. 660.964, Feb. 26, 1991, Pat. No. 5,074,500, which is a continuation of Ser. No. 391,230, Aug. 8, 1989, abandoned.

[51] Int. Cl.[5] ..... B65D 33/00

[52] U.S. Cl. ..... 220/404; 220/306; 220/307; 220/908; 383/33; 383/36; 248/99

[58] Field of Search ..... 220/403, 404, 737, 740, 220/86.1, 908, 306, 307, 9.1; 383/33, 36; 248/99, 100, 101

[56] References Cited

U.S. PATENT DOCUMENTS

| | | | |
|---|---|---|---|
| 3,095,578 | 7/1963 | Stanford | 248/99 |
| 3,768,763 | 10/1973 | Hembreg | 248/97 |
| 3,961,443 | 6/1976 | Insalaco | 220/306 X |
| 4,194,645 | 3/1980 | Zabner et al. | 220/306 |
| 4,378,924 | 4/1983 | Christensen | 248/101 |
| 4,497,463 | 2/1985 | Wendel | 248/95 |
| 4,550,440 | 10/1985 | Rico | 383/33 |
| 4,765,579 | 8/1988 | Robbins, III et al. | 248/101 |
| 4,921,196 | 5/1990 | Rudko | 248/97 |
| 5,014,943 | 5/1991 | Nelson et al. | 248/99 |
| 5,020,751 | 6/1991 | Larkin | 248/99 |

*Primary Examiner*—Stephen Marcus
*Assistant Examiner*—Stephen Cronin
*Attorney, Agent, or Firm*—Sprung Horn Kramer & Woods

[57] ABSTRACT

A waste disposal comprises (1) a bag part made of flexible material which has a closed lower end and an open upper end, (2) a bag collar made of relatively stiff material which is firmly attached to the upper end of the bag part, and (3) a lid which is adapted to be placed on the bag collar to close and seal the bag. The circumference of the bag collar is fitted with support elements for the lid so that the lid can be easily removed or can be inserted into or placed on the bag collar. Catch elements are provided below the support elements and function together with compatible elements on the lid to tightly secure the lid to the bag collar. The lid is fitted with at least one handle for carrying the bin.

8 Claims, 3 Drawing Sheets

WASTE DISPOSAL BAG WITH A BAG COLLAR AND LID

This is a division of application Ser. No. 07/660,964, filed Feb. 26, 1991, now U.S. Pat. No. 5,074,500, which in turn is a continuation of Application Ser. No. 07/391,230, filed Aug. 8, 1989, now abandoned.

BACKGROUND OF THE INVENTION

The present invention relates to a waste disposal bag that comprises (1) a bag part made of flexible material which has a closed lower end and an open upper end, (2) a bag collar made of relatively stiff material which is firmly attached to the upper end of the bag part, and (3) a lid which is adapted to be placed on the bag collar to close and seal the bag.

A container of this type is known from the German Utility Model Patent No. 82 05 292. This container is comprised of a block-shaped bottom bag for liquids and a container lid firmly attached thereto. This container lid is fitted with a spout for pouring liquids.

On the other hand, waste disposal bags are known which simply take the form of a flexible bag that is hung on a frame. In such cases a circular collar is attached to the frame over which the upper rim of the bag is folded and, if required, secured with a ring or the like.

SUMMARY OF THE INVENTION

It is a general object of the present invention to provide a container for the disposal of waste. For this purpose the block bottom bag mentioned above is not suitable. The disposal of waste requires the lid to be as large as possible, into which the accruing portions of waste can be easily thrown. When the bag is full, it should be possible to remove the container with the waste hygienically and without danger. In the case of the second bag referred to above, the bag is removed by pulling the foldable rim upwards and sealing it with a clip or a cord. During this process there is a danger of compressing gaseous emanations from the waste which might be inhaled by service personnel. Although this is not usually dangerous, in the case of contaminated or strong smelling waste, it can lead to problems of hygiene.

A particular object of the present invention is therefore to provide a waste disposal bag with which even "problemmatic wastes"—that is, contaminated or strong smelling wastes—can be collected and removed hygienically and safely after the bag has been filled.

These objects, as well as other objects which will become apparent from the discussion that follows, are achieved, according to the present invention, by providing a bag of the type described above, in which (1) the circumference of the bag collar is fitted with support elements for the lid so that the lid can be easily removed or can be inserted into or placed on the bag collar, and (2) catch elements are provided below the support elements and function together with compatible elements on the lid to tightly secure the lid to the bag collar. Preferably, the lid is fitted with at least one handle for carrying the bag.

The bag according to the present invention, as described above in its fundamental elements, permits the following special mode of operation:

The bag can be hung in a frame, for example, which is fitted with a hoop that mates with the stiff bag collar. The lid can be placed into the bag collar loosely or, if necessary, attached to the collar by means of a hinge, a flexible strap or similar means. On disposing of waste with this bag, the lid need only be lifted, lowered again and placed onto the collar. The support elements are employed for this purpose. Below the support elements are the catch elements which function together with corresponding elements on the lid in such a manner that, after the bag has been filled, the lid can be pressed into the catch elements and so engaged that the filled bag part and lid together can be easily and safely handled as a unit. It is essential that the weight of the full bag hang down from the support elements and thus the attached lid. The lifting of the sealed bag by means of the lid handle is a control as to whether the lid is indeed firmly closed and sealed at the bag collar and can subsequently be transported without danger, even when tipped to one side.

Easily combustible plastics such as polyethylene or polypropylene, mixed polymerisates and the like, which are largely chemically inert and which do not develop contaminating gases when burned, are suitable for the bag part and the stiffer parts of the container.

The lid can be fitted over the bag collar (clap lid), it can be inserted into the collar (inner lid) or it can be fitted with a U-shaped rim that covers the bag collar from above as well as fitting over both the inner and the outer side of at least part of the bag collar. Corresponding catch elements can be attached to the outside, to the inside or to the top of the bag collar.

Generally a circular-shaped bag collar may be chosen. It is nevertheless also possible to form the bag collar in a polygonal shape, whereby such a bag can be only hung in correspondingly shaped frames and can thus be immediately identified as a "safety hazard".

The preferred embodiments of the invention will now be described with the aid of the accompanying drawings.

DESCRIPTION OF THE PREFERRED EMBODIMENTS

Figure 1:
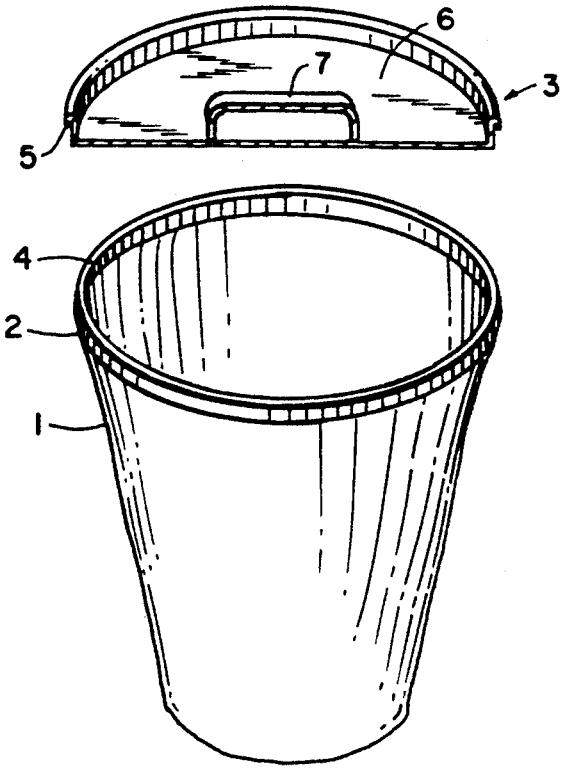
FIG. 1 is a perspective view of a waste disposal bag with a bag collar and lid according to a first embodiment of the present invention.

The waste disposal bag represented in FIG. 1 comprises a bag part 1 made of a flexible material with the lower end closed, which can be made, for example, of 0.5 mm thick polyethylene sheeting. Other materials can also be employed; for instance, the bag can be made of laminated paper, bonded textiles or similar fabrics. All materials which are impervious to air and water, and which are chemically resistant to the wastes deposited in the bag, are in principle suitable.

Figure 3:
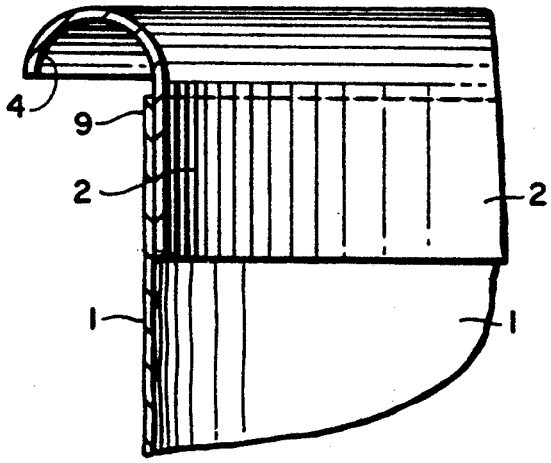
FIG. 3 is a cross-sectional view of a portion of the bag collar in the first embodiment.

The upper end of the flexible bag part 1 is enclosed in a bag collar of a stiff material and is attached firmly to it, for example, by means of a bonding 9, as this is illustrated in FIG. 3. The stiff bag collar can consist, for instance, of an encircling polyethelene section. The stiffness of this bag collar can be so great that the collar practically cannot be bent by hand. It is, however, also possible to construct it so that it is only relatively stiffer than the rest of the bag material. In this case the stiffness is achieved in use by hanging it in a frame that grips the collar, thus holding it in a particular configuration.

Figure 2:
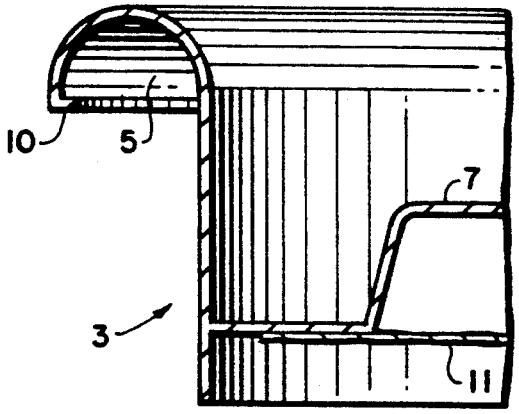
FIG. 2 is a cross-sectional view of a portion of the lid in the first embodiment.

Furthermore, there is provided a lid 3 which is also made of a plastic such as polyethylene, and which is to be placed from above on the bag collar 2. For this purpose, the bag collar 2 is fitted with support elements: in this embodiment a rim lug 4 which is bent upwards. A turnback rim 5 compatible with the rim lug 4 is fitted to the lid 3. The turnback rim 5 is fitted with a notched edge 10 which, when the lid is pressed down firmly, protrudes under the lower edge of the lugged rim 4 and locks the lid in place. The inner side 6 of the lid 3 is lined and the lid is fitted with a handle 7. As can be seen in FIG. 2, the inside of the lid is covered with a sheet layer 11 that is made of the same material as the flexible bag part 1.

In the embodiment of the bag just described it is possible to take hold of the lid by the handle, lift it easily and place it on the bin collar 2, whereby the notched elements 4, 5, 10 do not lock together but merely rest on each other. If greater pressure is applied to the lid rim the notched rim edge 10 arrives below the rim 4 and locks the lid firmly to the collar. Subsequently, the lid can be lifted together with the collar and bag and carried for disposal.

Figure 4:
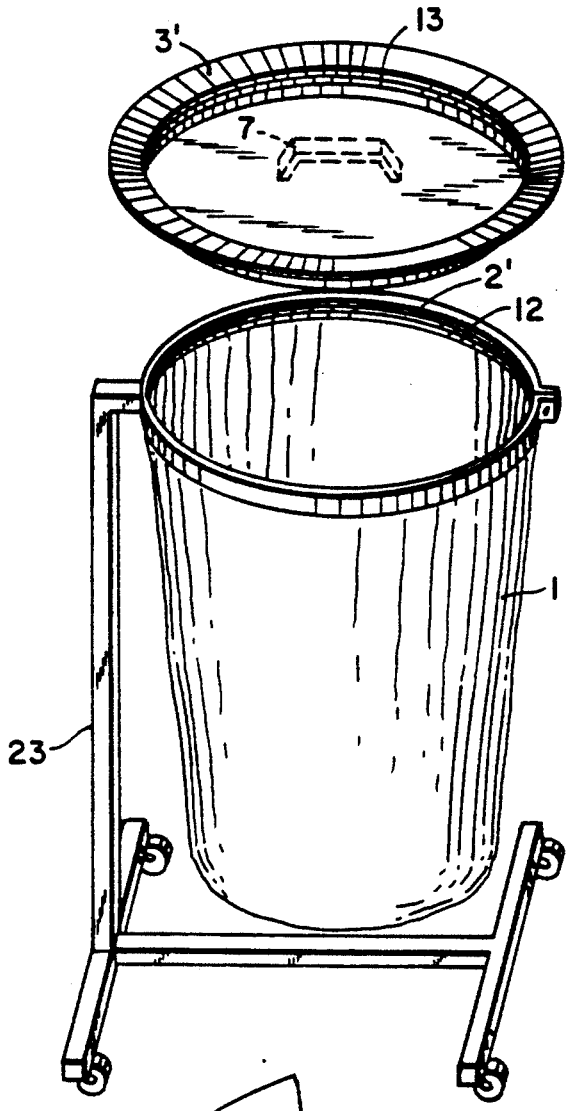
FIG. 4 is a perspective view of a bag with a bag collar and lid according to a second embodiment of the present invention.

FIG. 4 illustrates an embodiment in which the waste disposal bag possesses a bag collar 2' and a lid 3' which takes the form of an inner lid that can be placed in the bag collar 2'. A circumferential lug 12 lies within the bag colar 2' and forms the support elements on which the lid 3' rests and latches after being pressed down firmly. For this purpose, the lid 3' is fitted with a flattened slot 13 that circumscribes the lid.

Figure 5:
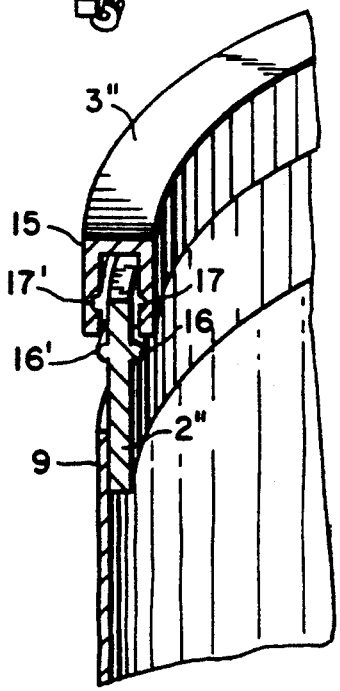
FIG. 5 is a detailed perspective and cross-sectional view of a bag and bag collar according to a third emobidment of the present invention.

FIG. 5 shows a further emobidment of a bag with a bag collar 2'' which is equipped with lid 3''. This lid is fitted with a rim 15 having a U-shape section. The rim 15 fits from above over both the inside and the outside of the collar 2''. In this embodiment, the lid 3'' is closed in its mid-section, although this midsection has been omitted from the figure for reasons of clarity. Corresponding ridged elements—in this instance, ring lugs, 16, 16'—are made on both the inside and the outside of the bag collar 2'' and lock together with corresponding slots or grooves 17, 17' within the lid 3'' when the lid is pressed down. As long as no locking takes place, the lid rim merely rests on the upper surface of the ring lugs 16 and 16'.

Figure 6:
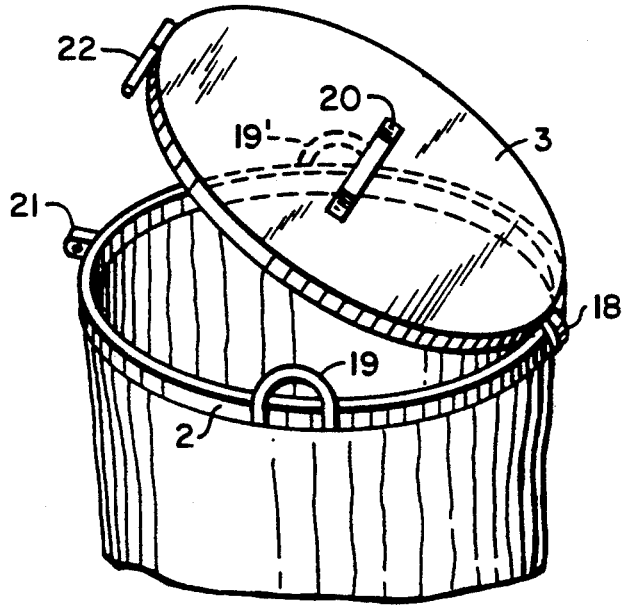
FIG. 6 is a perspective view of a fourth embodiment of the invention with a hinge and lock for the lid.

FIG. 6 shows an embodiment which utilizes a lid similar to that in FIG. 1. However, in this case the lid 3 is attached to the bag collar 2 by means of a hinge-like strap 18 so that the lid 3 can be moved in a hinge-like manner up and down in relation to the bag collar 2. In addition, the bag collar 2 is fitted with two handles 19, 19'. In this embodiment, the lid 3 is only equipped with a grip recess 20 which serves as a handle. It can nevertheless be lifted out of its holding position with this grip recess and the bin may be carried by means of the two handles 19, 19'. Furthermore, in this case, the lid is connected to a lock 21 that is attached to a locking bar 22 on the lid. By this means the bag can also be sealed so that it is inaccessible to unauthorized persons.

Figure 7:
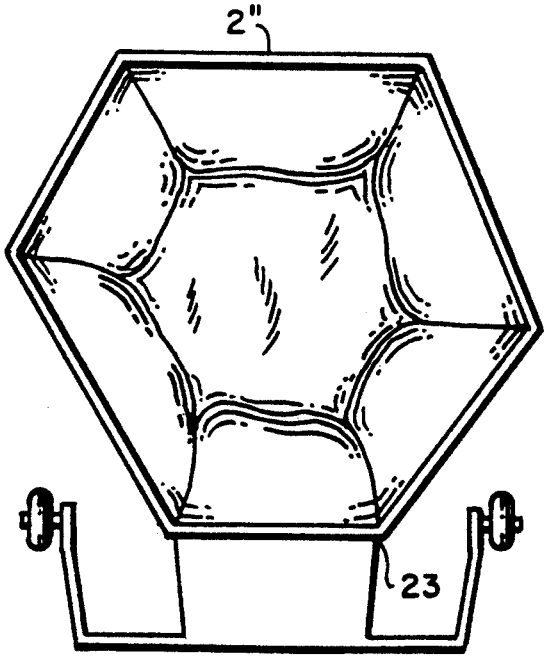
FIG. 7 is a top view of a bag with a bag collar shaped as a polygon according to a fifth embodiment of the present invention.

Finally, attention is drawn to FIG. 7 which represents a top view of a bag collar 2''' in the form of an irregular hexagon having a polygonal outline. Such a "stand-up-collar" 2''' has the advantage of fitting only into specified frames, labelled

What is claimed is:

1. In a closable bag suitable for the disposal of trash, garbage and other waste products, said bag comprising:

(a) a bag part made of flexible material having a closed lower end and an open upper end;

(b) a bag collar made of relatively stiff material which is firmly attached to said upper end of said bag part; and (c) a lid adapted to be placed on said bag collar so as to close and seal said bag at its upper end;

the improvement wherein said collar includes support elements for said lid around its circumference so that the lid can be raised easily or can be placed on or inserted in said bag collar, wherein catch elements are disposed around said bag collar for interlocking with compatible elements on said lid to secure said lid tightly to said bag collar and wherein said lid includes a rim that has a U-shaped cross-section, said rim being adapted to cover the top of said bag collar and to overlap at least part of the inside and outside surfaces thereof, and wherein said catch elements are disposed on at least one of the inside, outside and top of said bag collar, whereby said lid, said bag collar and said bag are disposable as a unit.

2. In a closable bag suitable for the disposal of trash, garbage and other waste products, said bag comprising:

(a) a bag part made of flexible material having a closed lower end and an open upper end;

(b) a bag collar made of relatively stiff material which is firmly attached to said upper end of said bag part; and (c) a lid adapted to be placed on said bag collar so as to close and seal said bag at its upper end;

the improvement wherein said collar includes support elements for said lid around its circumference so that the lid can be raised easily or can be placed on or inserted in said bag collar, wherein catch elements are disposed around said bag collar for interlocking with compatible elements on said lid to secure said lid tightly to said bag collar with at least such a strength that the weight of a trash-filled bag is firmly held by the collar-lid connection and such that the bag and lid may be carried as a unit by holding only the lid, and wherein said lid comprises at least one handle to permit said lid and said bag and bag collar to be carried as a unit by holding said lid alone.

3. The bag according to claim 2, wherein said lid is constructed in the form of a clap-lid that can be placed over said bag collar, a clap rim on said bag collar being made in the form of a combined support element and catch element.

4. The bag according to claim 2, wherein said lid includes a rim that has a U-shaped cross-section, said rim being adapted to cover the top of said bag collar and to overlap at least part of the inside and outside surfaces thereof, and wherein said catch elements are disposed on at least one of the inside, outside and top of said bag collar.

5. The bag according to claim 2, wherein said bag collar is made of somewhat flexible material which is stiffer than the material forming said bag part.

6. The bag according to claim 2, wherein the lower side of said lid is lined with a sheet material.

7. The bag according to claim 6, wherein said sheet material is the same as the material forming said bag part.

8. The bag according to claim 2, wherein said one handle comprises a single handle, disposed at substantially the center thereof.

* * * * *